US005618773A

United States Patent [19]

Bailey et al.

[11] Patent Number: 5,618,773

[45] Date of Patent: Apr. 8, 1997

[54] STABILIZERS FOR DYE-DONOR ELEMENT USED IN THERMAL DYE TRANSFER

[75] Inventors: David B. Bailey, Webster; Kristine B. Lawrence, Rochester, both of N.Y.

[73] Assignee: Eastman Kodak Company, Rochester, N.Y.

[21] Appl. No.: 620,714

[22] Filed: Mar. 21, 1996

[51] Int. Cl.[6] ..... B41M 5/035; B41M 5/38

[52] U.S. Cl. ..... 503/227; 428/195; 428/412; 428/913; 428/914

[58] Field of Search ..... 8/471; 428/195, 428/412, 913, 914; 503/227

[56] References Cited

U.S. PATENT DOCUMENTS

| | | | |
|---|---|---|---|
| 5,266,551 | 11/1993 | Bailey et al. | 503/227 |
| 5,288,691 | 2/1994 | Vanier et al. | 503/227 |

*Primary Examiner*—Bruce H. Hess
*Attorney, Agent, or Firm*—Harold E. Cole

[57] ABSTRACT

This invention relates to a dye-donor element for thermal dye transfer comprising a support having thereon a dye layer comprising an image dye in a polymeric binder, and wherein the dye layer also contains a stabilizer comprising an oligomeric, polycarbonate polyol having a molecular weight between about 1000 and about 10,000.

18 Claims, No Drawings

STABILIZERS FOR DYE-DONOR ELEMENT USED IN THERMAL DYE TRANSFER

This invention relates to the use of certain polycarbonate polyol stabilizers in dye-donor elements for thermal dye transfer systems.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

An important requirement for any thermal dye-donor element is to maintain performance over its useful lifetime without degradation in the quality of the image. The dye layer of a dye-donor element for resistive head thermal dye transfer generally comprises a polymeric binder and diffusible dyes. The percentage of dye in the layer is typically quite high, in the range of 20 to 80%. The dye is usually dissolved in the binder or phase-separated into small domains. During keeping of the donor, the temperature and humidity may be elevated and the dye layer is in contact with a slipping layer coated on the back side of the donor element when it is wound up in spool form. The slipping layer may contain mobile lubricating oils or materials which can act as plasticizers or solvents for the dye layer. This enables the dye to become mobile, allowing changes to occur in the layer including further phase separation, migration of the dye to the surface, and even crystallization of the dye. Dye may also transfer to the slipping layer. These changes generally result in sensitometric variations, nonuniform printing due to light or dark spots and dye smearing from a high density to a low density area of the print.

U.S. Pat. No. 5,288,691 relates to the use of mixtures of monomeric or oligomeric glass materials or compounds containing a phenylindane moiety as stabilizers for dye-donor elements to minimize sensitometric changes on donor storage or keeping. However, the use of compounds according to this invention for such a purpose is not disclosed.

U.S. Pat. No. 5,266,551 discloses the use of polycarbonate polyols which can react with multifunctional isocyanates to generate a crosslinked polymer network for a dye-receiver element for thermal dye transfer printing. However, there is no disclosure in this patent that such materials would be useful as a stabilizer in a dye-donor element.

It is an object of this invention to provide a stabilizer for a dye-donor element in which sensitometric changes upon storage and keeping are minimized and dye efficiency during printing is maintained.

These and other objects are achieved in accordance with this invention which relates to a dye-donor element for thermal dye transfer comprising a support having thereon a dye layer comprising an image dye in a polymeric binder, and wherein the dye layer also contains a stabilizer comprising an oligomeric, polycarbonate polyol having a molecular weight between about 1000 and about 10,000, preferably from about 1000 to about 5000.

In a preferred embodiment of the invention, the stabilizer comprises an oligomeric polycarbonate polyol comprising a mixture of aromatic and/or aliphatic diols linked by carbonate groups and having two terminal hydroxy groups.

In another preferred embodiment of the invention, the stabilizer can be represented by the following formula:

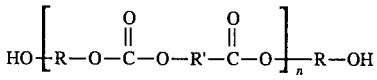

wherein R and R' each independently represents a divalent aliphatic group having from about 2 to about 16 carbon atoms or an aromatic radical having from about 6 to about 30 carbon atoms, and n is between 2 and 10.

By using the stabilizers of the present invention, sensitometric changes of dye-donor elements upon keeping can be minimized. Also, the stabilizers used in the present invention exhibit improved solubility characteristics in preferred coating solvents.

The polycarbonate polyols used in the invention may be formed by the reaction of a bis(chloroformate) with a diol. One of the monomers is used in excess and becomes the end group. Alternatively, the bis(chloroformate) could be in excess to give a chloroformate-terminated oligomer which is then hydrolyzed to form a hydroxyl group. Polyols can be prepared from these monomers with either R or R' in excess according to the following equation:

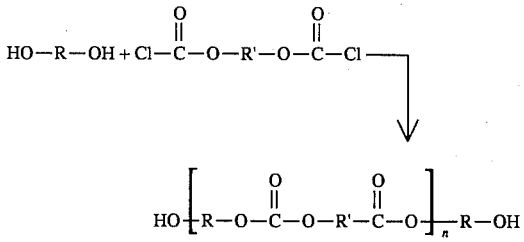

Examples of bis(chloroformates) which can be used in the above reaction include:

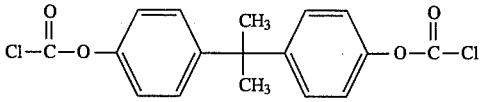

M1: bisphenol A bis (chloroformate)

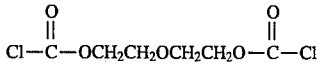

M2: diethylene glycol bis (chloroformate)

or

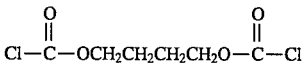

M3: butanediol bis (chloroformate).

Examples of diols which can be used in addition to diethylene glycol, butanediol, pentanediol, nonanediol include the following:

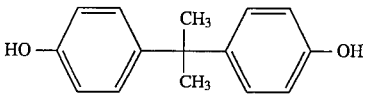

M4: bisphenol A

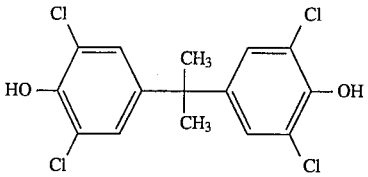

M5: 2, 2', 6, 6'-tetrachlorobisphenol A

-continued

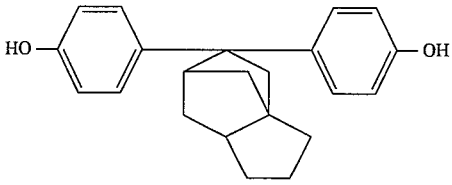

M6: 4, 4'-(octahydro-4, 7-methano-5H-inden-5-ylidene) bisphenol

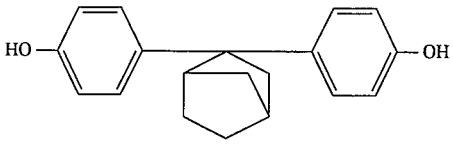

M7: 4, 4'-bicyclo [2, 2, 2] hept-2-ylidenebisphenol

The above monomers and other aliphatic and aromatic diols may be combined to form a variety of compositions, and compounds of different chain lengths and end groups. The polyol could have terminal aliphatic hydroxyl end groups (e.g., diethylene glycol end groups) or phenolic terminal groups (e.g., bisphenol A end groups). In addition, appropriate amounts of multifunctional (>2) alcoholic groups of either phenolic or aliphatic nature, such as glycerol, could be added to yield branched oligomeric polyols.

Following are examples of stablizers which may be used in the invention:

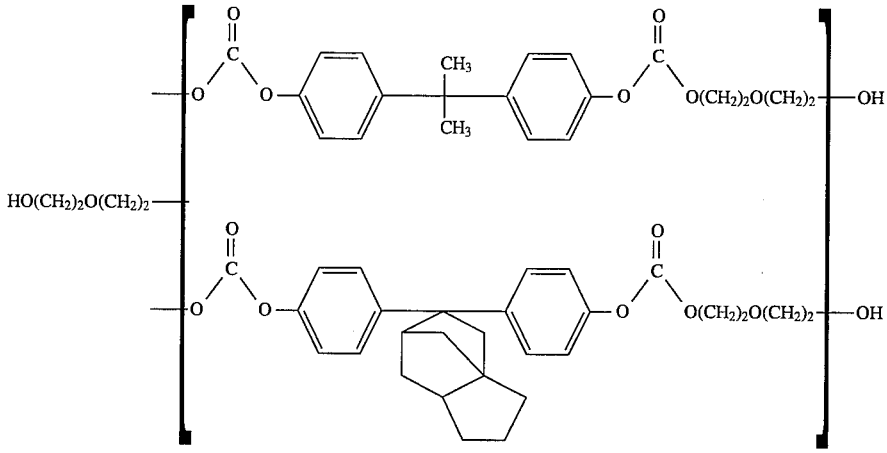

| Stabilizer | moles of monomer M2 | M4 | M6 | ratio* alip./arom. | MW** |
|---|---|---|---|---|---|
| G-1 (Tg = 53° C.) | 0.50 | 0.325 | 0.325 | 10/13 | 1950 |
| G-2 (Tg = 51° C.) | 0.50 | 0.30 | 0.30 | 10/12 | 2850 |

*represents aliphatic/aromatic monomer ratio, yielding aliphatic end groups
**refers to polystyrene equivalent molecular weight

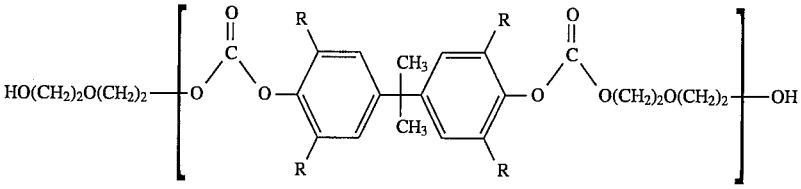

| STABILIZER | R | mole of monomer M2 | M4 | M5 | ratio* alip./arom. | MW** |
|---|---|---|---|---|---|---|
| G-3 (Tg = 29° C.) | H | 0.26 | 0.20 | — | 13/10 | 2780 |
| G-4 (Tg = 32° C.) | H | 0.24 | 0.20 | — | 12/10 | 3740 |

-continued

| | | | | | | |
|---|---|---|---|---|---|---|
| G-5 (Tg = 77° C.) | Cl | 0.12 | — | 0.10 | 12/10 | 3600 |
| G-6 (Tg = 64° C.) | Cl | 0.13 | — | 0.10 | 13/10 | 3100 |
| G-7(Tg = 58° C.) | Cl | 0.15 | — | 0.10 | 15/10 | 2600 |

*represents aliphatic/aromatic monomer ratio, yielding aliphatic end groups
**refers to polystyrene equivalent molecular weight In a preferred embodiment of the invention, the stablizer is present at a concentration of from about 5 to about 25% by weight of the dye layer.

Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

M-1

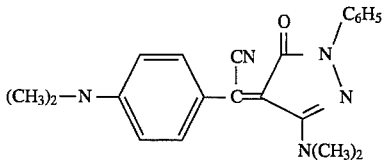

(magenta)

M-2

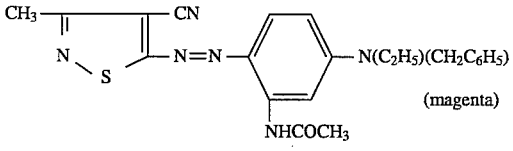

(magenta)

M-3

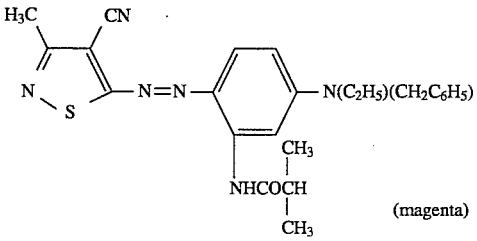

(magenta)

M-4

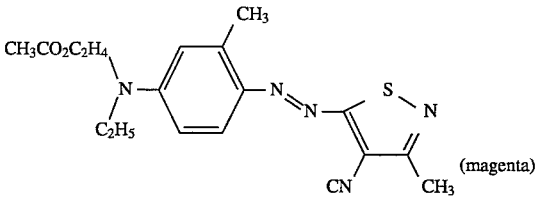

(magenta)

-continued

C-1

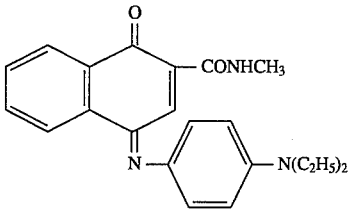

(cyan)

C-2

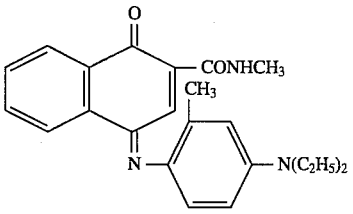

(cyan)

C-3

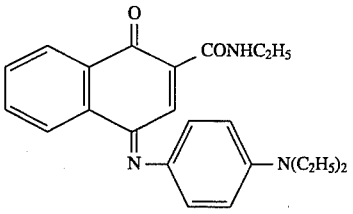

(cyan)

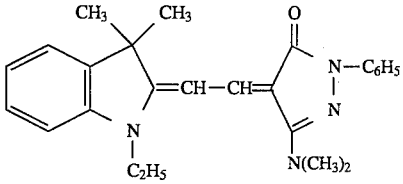

(yellow)

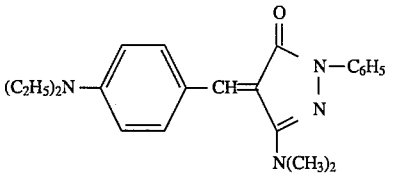

(yellow)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layer of the dye-donor element may be coated on the support or printed thereon by a printing technique such as a gravure process.

Any material can be used as the support for the dye-donor element of the invention provided it is dimensionally stable and can withstand the heat of the thermal head. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 mm. It may also be coated with a subbing layer, if desired, such as those materials described in U.S. Pat. Nos. 4,695,288 or 4,737,486.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used.

The dye image-receiving layer may comprise, for example, a polycarbonate, a polyurethane, a polyester, polyvinyl chloride, poly(styrene-co-acrylonitrile), poly(caprolactone), a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have alternating areas of dyes such as sublimable cyan and/or magenta and/or yellow and/or black or other dyes. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and magenta, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Preparation of polycarbonate polyol from excess diethylene glycol bis(chloroformate) and bisphenol A-terminal aliphatic hydroxyl groups (G-4).

A 1-liter three-necked, round-bottomed flask equipped with an argon inlet, a mechanical stirrer, and an addition funnel was charged with diethylene glycol bis(chloroformate) (55.4 g, 0.24 mole), bisphenol A (45.7 g, 0.2 mole), ethyl acetate (325 ml) and cooled to 5° –10° C. with an ice bath. A solution of triethylamine (40.48 g, 0.4 mole) in ethyl acetate (75 ml) was slowly added over a 45 min period while stirring under an argon flow. The mixture was filtered from the white precipitate, rinsed with ethyl acetate, the combined ethyl acetate solutions were treated with 20 ml water and 50 ml acetone followed by 12 g of pyridine to hydrolyze the chloroformate end groups. The solution was washed with 600 ml of water containing 6 ml of concentrated hydrochloric acid, washed 3 times with a 600 ml sodium chloride solution, and dried over anhydrous potassium carbonate.

The solution was filtered, condensed on a rotary evaporator to 50 to 60% solids, and precipitated into 3 liters of a 50/50 methanol/ice water mixture. The soft taffy was ground in a blender with water to a hardened solid, filtered and air dried.

EXAMPLE 2

Control cyan dye donor 1 was prepared by coating 0.12 g/m$^2$ Tyzor TBT® titanium tetrabutoxide (DuPont Corp.) in a propyl acetate/butanol solvent mixture on both sides of a 6 μm poly(ethylene terephthalate) support.

On one side of the support was coated a slipping layer of 0.48 g/m$^2$ poly(vinyl acetal) (Sekisui Co.) binder, 0.007 g/m$^2$ BYKS732 copolymer of polypropylene oxide and polymethyloctyl siloxane, 98% Stoddard solvent (BYK Chemie), 0.010 g/m$^2$ PS513 aminopropyl-terminated polydimethylsiloxane (Huels Co.) and 0.0003 g/m$^2$ p-toluenesulfonic acid coated from a diethyl ketone/methanol solvent mixture.

On the reverse side of the support was coated cyan dye C-1 illustrated above, (0.37 g/m2), cyan dye C-2 illustrated above (0.11 g/m2), cellulose acetate propionate (CAP) binder (2.5% acetyl, 45% propionyl) (0.35 g/m2), S363NI micronized blend of polyethylene, polypropylene, and oxidized polyethylene particles (Shamrock Technologies, Inc.), (0.02 g/m2), and Flourad® FC 430 surfactant (3M Corp.) (0.002 g/m$^2$) dissolved in and coated from a toluene/methanol/cyclopentanone mixture.

Comparison dye-donor 2 was prepared similar to Control dye-donor 1 except that 0.11 g/m$^2$ of a Comparison Stabilizer (shown below) was added to the dye layer and the CAP binder was adjusted to 0.24 g/m$^2$ in order to achieve equivalent sensitometric response.

Dye-donors according to the invention were prepared similar to control dye-donor 2 except that they contained the stabilizers as listed in Table 1 instead of the Comparison Stabilizer.

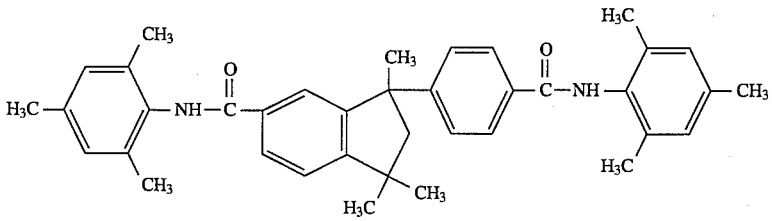

Comparison Stabilizer 2,4,6,-trimethylaniline-substituted phyenylindane

A dye-receiver element was prepared by extrusion laminating a paper core with a 38 μm thick microvoided composite film (OPPalyte® 350TW, Mobil Chemical Co.) as disclosed in U.S. Pat. No. 5,244,861. The composite film side of the resulting laminate was then coated with the following layers in the order recited:

1) subbing layer of Dow Z-6020 (an aminoalkylene aminotrimethoxysilane) (Dow Corning Co.) (0.11 g/m$^2$) coated from ethanol;
2) dye-receiving layer composed of Makrolon® KL3-1013 bisphenol A polycarbonate (Myles Laboratories) (1.776 g/m2), Lexan® 141-112 polycarbonate (General Electric Co.) (1.453 g/m2), dibutyl phthalate (0.323 g/m2), diphenyl phthalate (0.323 g/m$^2$) and FC431® fluorosurfactant (3M Corp.) (0.011 g/m$^2$) coated from dichloromethane;
3) overcoat layer of a linear condensation copolycarbonate of bisphenol A (50 mole-%), diethylene glycol (49 mole-%), and 2,500 MW polydimethylsiloxane block units (1 mole-%) (11 g/m2), Fluorad FC431® (0.02 g/m$^2$) and Dow-Corning 510 Silicone Fluid (0.01 g/m$^2$) coated from dichloromethane.

Accelerated keeping tests were performed by hand-winding samples of the donors on plastic cores under constant tension against the poly(vinyl acetal) slipping layer described above and placing them (sealed at 40% RH in a foil-lined bag) into accelerated keeping ovens at 60° C./70% RH for 3 days. The results are listed in Table 1.

Eleven step sensitometric images were printed using incubated and room-kept donor samples. The dye side of a dye-donor element strip approximately 10 cm×13 cm in area was placed in contact with the dye image-receiving layer of the dye-receiver element of the same area. The assemblage was clamped to a stepper-motor driven 60 mm diameter rubber roller, and a TDK Thermal Head (No. L-231) (thermostatted at 30° C.) was pressed with a force of 24.4 newton (2.5 kg) against the dye-donor element side of the assemblage pushing it against the rubber roller.

The imaging electronics were activated causing the donor/receiver assemblage to be drawn between the printing head and roller at 11.1 mm/s. Coincidentally, the resistive elements in the thermal print head were pulsed for 64 μs/pulse at 129 μs intervals during the 16.9 μs/dot printing time. A stepped density image was generated by incrementally increasing the number of pulses/dot from 0 to 127. The voltage supplied to the print head was approximately 14.5 volts, resulting in an instantaneous peak power of 0.429 watts/dot and a maximum total energy of 3.49 mJ/dot. The Dmax values (step 11) and changes with incubation of Status A red densities at O.D.=0.50 are listed in Table 1 as follows:

TABLE 1

| | | Red Density (Steps 4 or 5) | | |
|---|---|---|---|---|
| Stabilizer | D-max | Before Incub. | After Incub. | Diff. |
| None | 2.45 | 0.55 | 0.96 | 0.41 |
| Comparison | 2.46 | 0.57 | 0.66 | 0.09 |
| G-1 | 2.45 | 0.47 | 0.45 | −0.02 |
| G-2 | 2.44 | 0.46 | 0.47 | 0.01 |
| G-3 | 2.68 | 0.44 | 0.43 | −0.01 |
| G-4 | 2.64 | 0.42 | 0.51 | 0.09 |

The above data show that the stabilizers of this invention (G-1 through G-4) decrease the sensitometric change of the dye-donors after incubation relative to the no stabilizer control. Stabilizers G-1 through G-3 also showed a decrease in sensitometric change after incubation relative to the Comparison Stabilizer. In addition, a 7%–9% increase in Dmax was achieved when using stabilizers G-3 and G-4 relative to the stabilizer-free control and the Comparison Stabilizer.

EXAMPLE 3

Example 2 was repeated but using the materials identified in Table 2 as follows:

TABLE 2

| | | Red Density (Steps 4 or 5) | | |
|---|---|---|---|---|
| Stabilizer | D-max | Before Incub. | After Incub. | Diff. |
| None | 2.36 | 0.49 | 0.85 | 0.36 |
| Comparison | 2.45 | 0.55 | 0.58 | 0.03 |
| G-5 | 2.48 | 0.58 | 0.64 | 0.06 |
| G-6 | 2.39 | 0.60 | 0.66 | 0.06 |
| G-7 | 2.63 | 0.60 | 0.67 | 0.07 |

The above data show that stabilizers G-5 through G-7 all decrease the sensitometric change of the donors after incubation relative to the stabilizer-free control. This demonstrates that the reduction in sensitometric changes achievable with the stabilizers, of this invention are independent of the molecular weight of the stabilizer used.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having thereon a dye layer comprising an image dye in a polymeric binder, the improvement wherein said dye layer also contains a stabilizer comprising an oligomeric, polycarbonate polyol having a molecular weight between about 1000 and about 10,000.

2. The element of claim 1 wherein said stabilizer is present at a concentration of from about 5 to about 25% by weight of said dye layer.

3. The element of claim 1 wherein said stabilizer comprises an oligomeric polycarbonate polyol comprising a mixture of aromatic and/or aliphatic diols linked by carbonate groups and having two terminal hydroxy groups.

4. The element of claim 1 wherein said stabilizer is represented by the following formula:

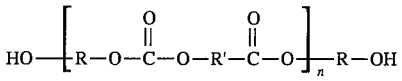

wherein R and R' each independently represents a divalent aliphatic group having from about 2 to about 16 carbon atoms or an aromatic radical having from about 6 to about 30 carbon atoms, and n is between 2 and 10.

5. The element of claim 1 wherein said stabilizer is

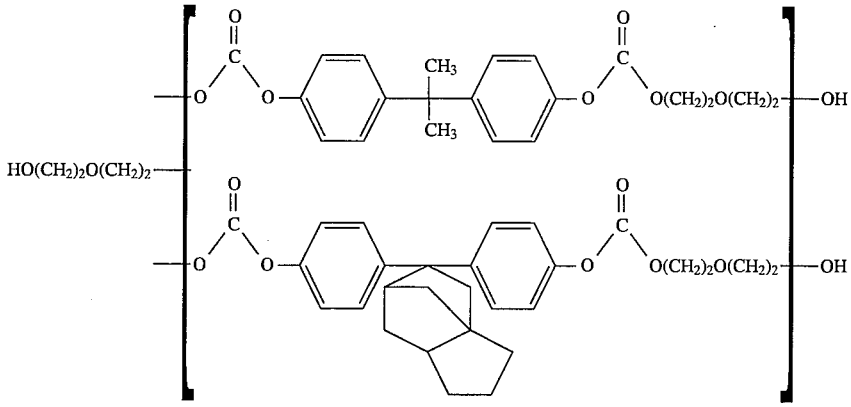

6. The element of claim 1 wherein said stabilizer is

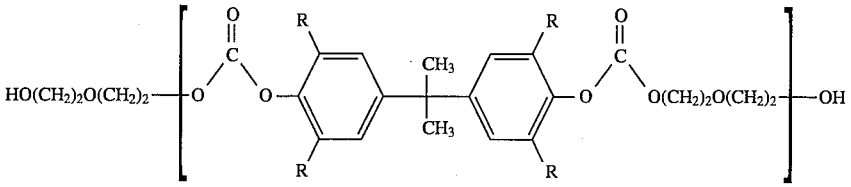

7. A process of forming a thermal dye transfer image comprising:

I) contacting at least one dye-donor element comprising a support having thereon a dye layer comprising an image dye in a polymeric binder, with a dye-receiving element comprising a support having thereon a polymeric dye image-receiving layer;

II) imagewise-heating said dye-donor element; and

III) transferring a dye image to said dye-receiving element to form said thermal dye transfer image, wherein said dye layer also contains a stabilizer comprising an oligomeric, polycarbonate polyol having a molecular weight between about 1000 and about 10,000.

8. The process of claim 7 wherein said stabilizer is present at a concentration of from about 5 to about 25% by weight of said dye layer.

9. The process of claim 7 wherein said stabilizer comprises an oligomeric polycarbonate polyol comprising a mixture of aromatic and/or aliphatic diols linked by carbonate groups and having two terminal hydroxy groups.

10. The process of claim 7 wherein said stabilizer is represented by the following formula:

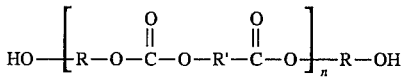

wherein R and R' each independently represents a divalent aliphatic group having from about 2 to about 16 carbon atoms or an aromatic radical having from about 6 to about 30 carbon atoms, and n is between 2 and 10.

11. The process of claim 7 wherein said stabilizer is

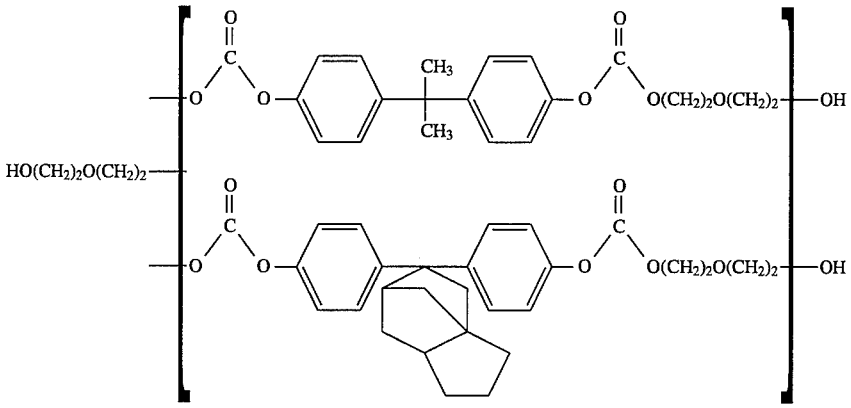

12. The process of claim 7 wherein said stabilizer is

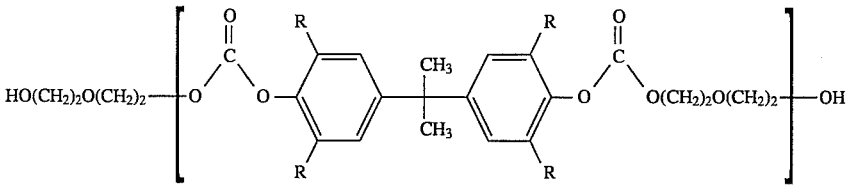

13. A thermal dye transfer assemblage comprising:

(I) a dye-donor element comprising a support having thereon a dye layer comprising an image dye dispersed in a polymeric binder, and (II) a dye-receiving element comprising a support having thereon a dye image-receiving layer, said dye-receiving element being in superposed relationship with said dye-donor element so that said dye layer is in contact with said dye image-receiving layer, wherein said dye layer also contains a stabilizer comprising an oligomeric, polycarbonate polyol having a molecular weight between about 1000 and about 10,000.

14. The assemblage of claim 13 wherein said stabilizer is present at a concentration of from about 5 to about 25% by weight of said dye layer.

15. The assemblage of claim 13 wherein said stabilizer comprises an oligomeric polycarbonate polyol comprising a mixture of aromatic and/or aliphatic diols linked by carbonate groups and having two terminal hydroxy groups.

16. The assemblage of claim 13 wherein said stabilizer is represented by the following formula:

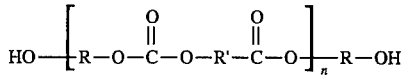

wherein R and R' each independently represents a divalent aliphatic group having from about 2 to about 16 carbon atoms or an aromatic radical having from about 6 to about 30 carbon atoms, and n is between 2 and 10.

17. The assemblage of claim 13 wherein said stabilizer is

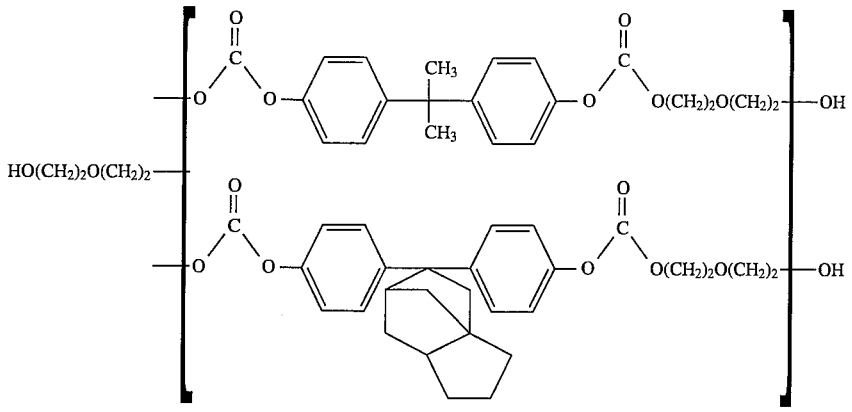
18. The assemblage of claim 13 wherein said stabilizer is
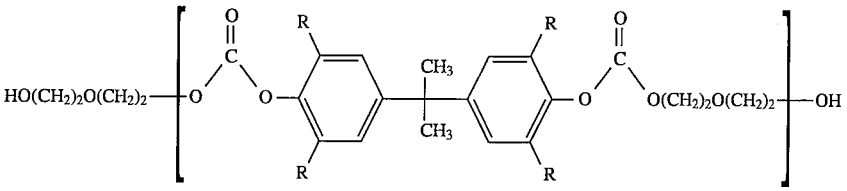
* * * * *

UNITED STATES PATENT AND TRADEMARK OFFICE

CERTIFICATE OF CORRECTION

PATENT NO. : 5,618,773

DATED : April 8, 1997

INVENTOR(S) : David B. Bailey and Kristine B. Lawrence

It is certified that error appears in the above-indentified patent and that said Letters Patent is hereby corrected as shown below:

On the title page, after item [22], insert
--Related U.S. Application Data
[63] Provisional Application Serial No. 60/001,374, filed July 24, 1995.--

In Column 1, line 3, insert
--CROSS REFERENCE TO RELATED APPLICATION
Reference is made to and priority claimed from U.S. Provisional Application Serial No. US 60/001,374, filed 24 July 1995, entitled STABILIZERS FOR DYE-DONOR ELEMENT USED IN THERMAL DYE TRANSFER--.

Signed and Sealed this

Twenty-sixth Day of August, 1997

*Attest:*

Bruce Lehman

BRUCE LEHMAN

*Attesting Officer*

*Commissioner of Patents and Trademarks*